US006083127A

United States Patent [19]

O'Shea

[11] Patent Number: 6,083,127

[45] Date of Patent: Jul. 4, 2000

[54] ENERGY ABSORBING SOUND EMITTING TOY DART

[75] Inventor: Gerrard M. O'Shea, Burlington, Ky.

[73] Assignee: Hasbro, Inc., Pawtucket, R.I.

[21] Appl. No.: 09/209,711

[22] Filed: Dec. 11, 1998

[51] Int. Cl.[7] ..... A63H 33/18

[52] U.S. Cl. ..... 473/571; 446/213; 446/404

[58] Field of Search ..... 446/213, 216, 446/397, 404; 473/571, 578, FOR 216

[56] References Cited

U.S. PATENT DOCUMENTS

| | | | |
|---|---|---|---|
| 2,443,395 | 6/1948 | Lutins | 446/216 X |
| 2,757,932 | 8/1956 | Shaw | 473/571 |
| 2,836,930 | 6/1958 | Ragazzo et al. | 446/213 |
| 2,838,871 | 6/1958 | Boring | 446/216 |
| 3,418,995 | 12/1968 | Heller | 473/571 X |
| 3,784,199 | 1/1974 | Chmela | 273/398 |
| 4,030,761 | 6/1977 | Daller | 473/572 |
| 4,111,422 | 9/1978 | Burcenski | 273/399 |
| 4,167,831 | 9/1979 | Arzola | 446/215 |
| 4,203,252 | 5/1980 | Howie | 446/216 |
| 4,318,244 | 3/1982 | Magid et al. | 446/188 |
| 5,016,891 | 5/1991 | Nelson | 273/407 |
| 5,928,049 | 7/1999 | Hudson | 473/578 X |

OTHER PUBLICATIONS

Hasbro Toy Group Sales Literature Showing "Nerf Sonic Stinge" (2 pages, 1995).

Kenner Sales Literature Showing "Nerf Hydro Torpedoes" (2 pages, 1993).

*Primary Examiner*—John A. Ricci

*Attorney, Agent, or Firm*—Marshall, O'Toole, Gerstein, Murray & Borun

[57] ABSTRACT

A sound emitting toy dart includes an elongate body having a first end and a second end. A sound emitting end cap is secured to the first end. The end cap has a resilient wall member defining a cavity, and an aperture formed in the wall member in communication with the cavity. The aperture is formed as whistle and is further arranged to permit the evacuation of air from the cavity responsive to a collapsing of the wall member.

20 Claims, 3 Drawing Sheets

ENERGY ABSORBING SOUND EMITTING TOY DART

FIELD OF THE INVENTION

The present invention relates generally to toy projectiles, and more particularly, the present invention relates to an energy absorbing sound emitting end cap for use with a toy dart and a toy dart fitted with such an end cap.

BACKGROUND OF THE INVENTION

Toy darts, rockets and similar toy projectiles and the associated launching devices for these toy darts have long provided amusement for youngsters. To add to the enjoyment of observing the flight of the toy dart, whistles and other sounding generating devices have been included to create sounds as a result of air flowing over the toy dart during flight.

A recent type of toy dart or rocket has an elongate body formed from expanded or extruded polyethylene foam and foam fins secured to at least one end to guide the toy's flight. Toy darts of this configuration have the advantage that the polyethylene foam is inherently soft and energy absorbing, and thus, reduces the likelihood of damage or injury caused by the impact of the toy dart with an object or a person. In fact, toy industry requirements dictate that at least the leading edge of the toy dart meet certain criteria for the softness of the material.

To maintain the above-mentioned benefits of a foam toy dart, and recognizing that the typical sound emitting device is formed from harder plastic materials, it has been necessary to mount the sound emitting device along the body of the toy dart and not on the leading end of the toy dart. To accomplish such attachment at least requires forming an aperture in the body, and securing the sound emitting device within the aperture. This adds to the cost and complexity of toy. Another disadvantage associated with positioning the sound emitting device along the body is that it is removed from the direct air stream over the toy dart during flight, thereby reducing its effectiveness for emitting sound.

SUMMARY OF THE INVENTION

The present invention provides an energy absorbing sound emitting device that may be secured directly to a leading end of a toy dart. In accordance with an aspect of the present invention, a toy dart has an elongate body portion including a first end and a second end. An end cap is secured to the first end and includes a resilient wall portion that defines a cavity. A flange is formed connected to and extending from the wall portion, and the flange is sized to engage the first end of the toy dart for securing the end cap to the toy dart. An aperture is formed in the wall portion and in communication with the cavity. The aperture has an edge aligned substantially perpendicular to a direction of flight of the toy dart, and the edge and cavity cooperate to generate sound as a result of a flow of air over the aperture during flight of the toy dart.

In accordance with an additional aspect of the present invention, the cavity and the aperture cooperate to absorb energy upon the impact of the toy dart with an object by permitting the evacuation of air from within the cavity by way of the aperture during collapse of the wall portion.

The end cap may also have a mounting disk disposed adjacent the cavity which engages the first end of the toy dart when the end cap is secured to the first end of the toy dart.

The mounting disk may be secured to a mounting disk flange that extends into the cavity from either the wall portion or the flange.

The wall portion may have a convex disk portion and an annular skirt portion extending from the disk portion and coupled to the flange portion.

The aperture may be formed in either the disk portion or the skirt portion.

The end cap may also include a plurality of rib members formed within the cavity on an interior surface of the wall portion.

In accordance with still an additional aspect of the present invention, an outer surface of the wall portion may be formed to include aesthetic features.

In still another aspect of the present invention, the disk portion may be formed to include a suction cup arranged to permit the toy dart to become engaged with an object upon impact.

BRIEF DESCRIPTION OF THE DRAWINGS

These and other advantages and features of the present invention will be apparent to one of ordinary skill in the art from a review of the following detailed description of several preferred embodiments with reference to the attached drawings where like reference numerals are used to refer to like elements throughout and in which.

DETAILED DESCRIPTION THE PREFERRED EMBODIMENTS

Figure 1:
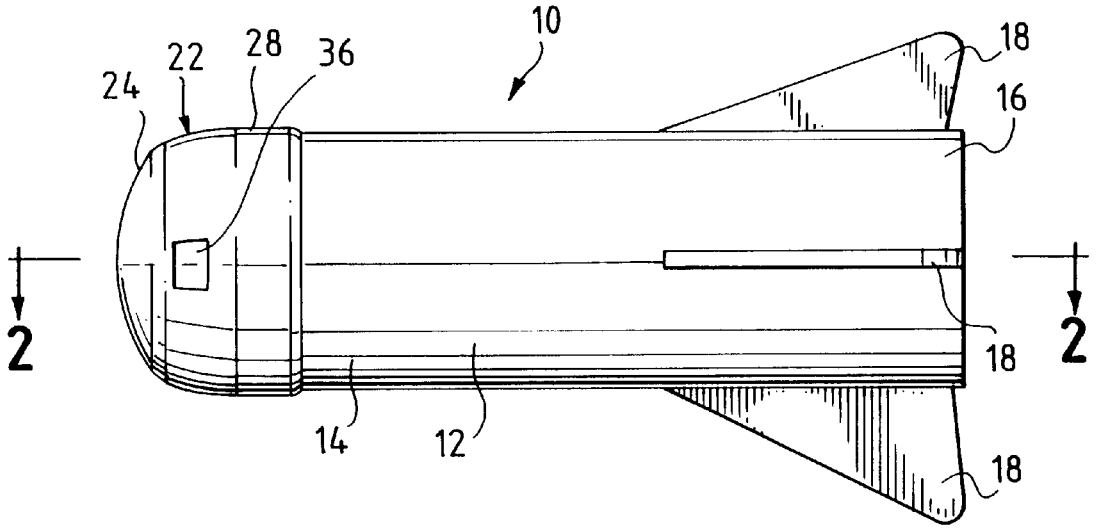
FIG. 1 is a side elevation view of a toy dart in accordance with a preferred embodiment of the present invention.
Figure 2:
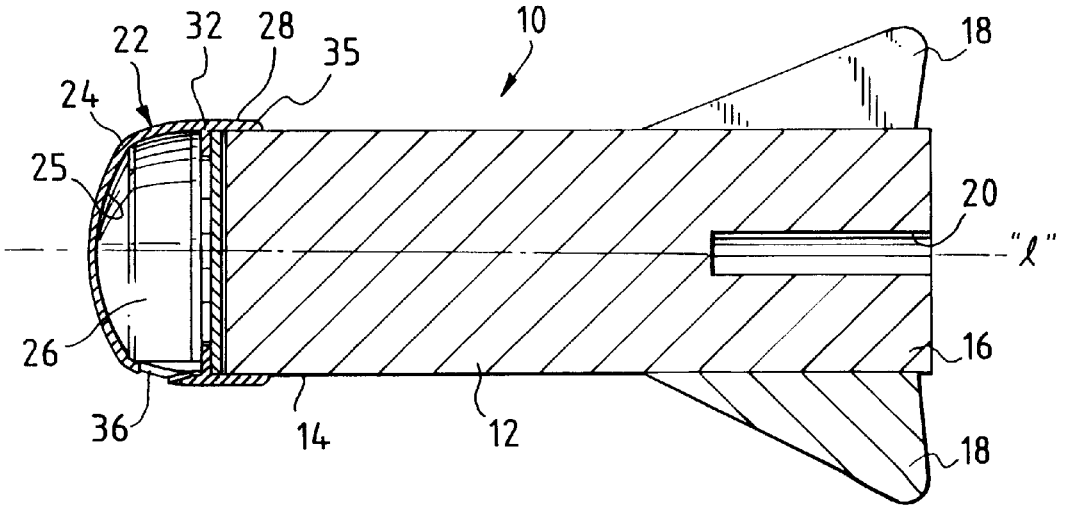
FIG. 2 is a cross-section view taken along line 2—2 of FIG. 1.

Referring to FIG. 1 and FIG. 2, a toy dart 10 includes an elongate body portion 12 having a first end 14 and a second end 16. Secured to second end 16 are a plurality of fins 18 for guiding the flight of toy dart 10. Not all toy darts will require fins, and for example small toy darts will likely not include fins. Therefore, it should be appreciated that fins 18 are not required for the sound generation or energy absorption features of the present invention. Toy dart 10 may be adapted for launching from virtually any type of toy dart launcher including, for example, compressed air launchers, spring launchers and bow type launchers. In this regard, toy dart 10 may include an axially extending cavity portion 20 formed in second end 16 for positioning toy dart 10 onto a suitable launcher. Elongate body portion 12 and fins 18 are each preferably formed from polyethylene foam extruded, expanded or otherwise suitably formed into the desired shape. Of course other foam materials may be used without departing from the fair scope of the present invention. Elongate body portion 12 has a generally cylindrical shape, and each of first end 14 and second end 16 are a substantially flat surface aligned generally perpendicularly to a longitudinal axis "1" of body portion 12. The longitudinal axis "1" of body portion 12 defines a preferred axis of flight for toy dart 10.

Secured to first end 14 is an energy absorbing sound emitting end cap 22. End cap 22 is preferably formed from a resilient material such as a thermoplastic elastomer in order to comply with various regulations. In this regard, end cap 22 is formed from a thermoplastic elastomer having a Shore "A" durometer less than 50, and preferably about 45. A material referred to commercially as Kraton D3226, compounded by GLS Corporation, Cary, Ill., is preferred for forming end cap 22. However, it will be appreciated that compliance with toy industry regulations may require use of alternate materials and/or alternate material specifications, and such variations are considered to fall within the fair scope of the present invention.

Referring still to FIG. 2 and also to FIGS. 3–6, end cap 22 includes a bowl shaped wall member 24 with an interior surface 25 defining a cavity 26. A flange 28 is formed extending axially, as shown in FIGS. 1 & 2 with respect to body portion 12, from wall member 24. Flange 28 has a cross-sectional configuration generally matching a cross-sectional configuration of first end 14, and flange 28 is further sized to engage first end 14 for securing end cap 22 to body portion 12. Disposed within end cap 22 is a mounting disk 30 which is secured to a mounting disk flange 32 preferably formed at an interface of wall member 24 and flange 28 and extending inwardly therefrom. Most preferably mounting disk flange 32 is formed as a plurality of segmented portions, one of which is shown at 34, and mounting disk 30 is preferably bonded to mounting disk flange 32 using adhesive.

Mounting disk 30 facilitates securing, by adhesive bonding, of end cap 22 to first end 14. Adhesive is applied to mounting disk 30, preferably at several locations about its circumference and adjacent flange 28, and end cap 22 is then brought into engagement with first end 14. Either end cap 22 or body portion 12 or both are then rotated with respect to each other. The rotation distributes the adhesive between mounting disk 30 and first end 14 as well as causes a wicking of adhesive between flange 28 and an outer surface portion 35 of body portion 12 (best seen in FIG. 2). Adhesive also wicks between mounting disk flange 32 and mounting disk 30 bonding the two together, and thus it will be appreciated that mounting disk 30 need not be separately bonded to mounting disk flange 32 prior to installing end cap 22 to first end 14.

With continuing reference to FIGS. 3–6, wall member 24 is formed to include an aperture 36, which is in communication with cavity 26. Aperture 36 has a generally rectangular configuration and includes a tapered edge 38 aligned substantially perpendicular to longitudinal axis "1" of body portion 12, i.e., edge 38 is aligned substantially perpendicular to an intended axis of flight of toy dart 10. This arrangement of edge 38 may be described as forming an edge-tone whistle. During flight, air flowing over wall member 24 is separated by edge 38 thereby generating eddies, which in cooperation with cavity 26, create a whistling sound during the flight of toy dart 10.

Figure 6:
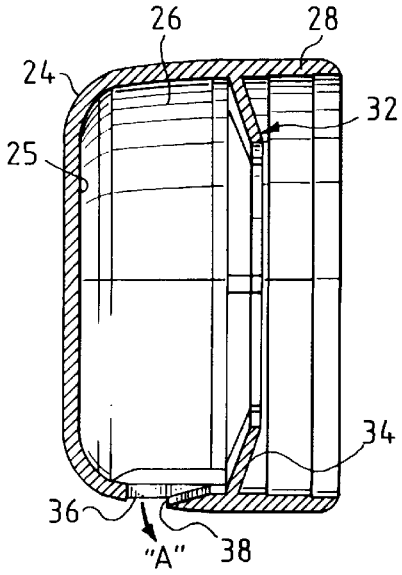
FIG. 6 is a cross-section view similar to FIG. 4 and further illustrating the end cap in an energy absorbing state.

With reference to FIG. 6, upon impact of toy dart 10 with an object, wall member 24 is designed to elastically deflect, thereby absorbing a substantial portion of the energy of the impact. As noted, wall member 24 is formed from a relatively soft material in order to absorb a portion of the energy of the impact. In accordance with the present invention, aperture 36 further permits the evacuation of air from within cavity 26 during the deflection or collapsing of wall member 24 under the force of the impact. The flow of air from cavity 26 is illustrated by arrow "A" in FIG. 6. By permitting the escape of air from cavity 26 via aperture 36 during collapse of wall member 24, the force of the impact of toy dart 10 upon an object is further substantially reduced. Thus, it will be appreciated that aperture 36 provides the dual functions of generating sound during the flight of toy dart 10 and enhancing the energy absorbing features of toy dart 10.

Figure 3:
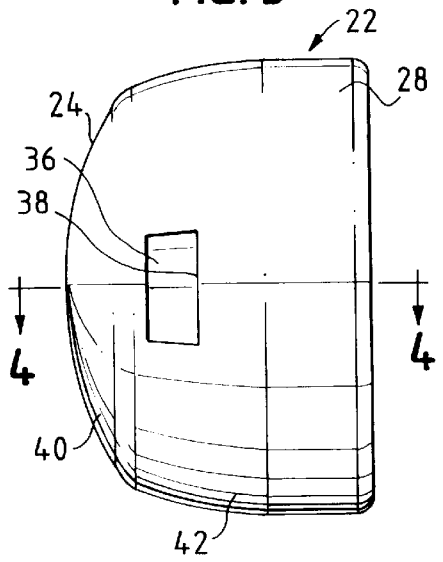
FIG. 3 is a side elevation view of an end cap in accordance with a preferred embodiment of the present invention.
Figure 4:
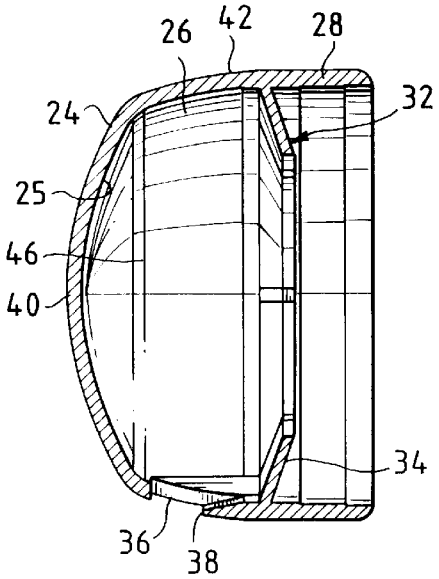
FIG. 4 is a cross-section view taken along line 4—4 of FIG. 3.
Figure 5:
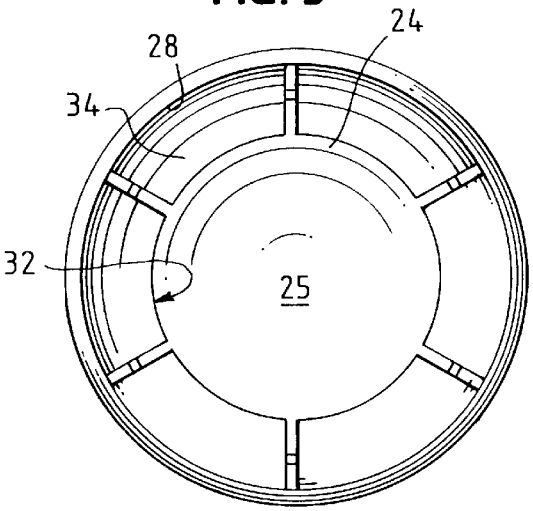
FIG. 5 is a rear elevation view of the end cap shown in FIG. 3.

As best seen in FIGS. 3 and 4, wall member 24 includes a convex disk portion 40 and an annular skirt portion 42 connecting to flange 28. Preferably aperture 36 is formed in skirt portion 42 near disk portion 40. This ensures that aperture 36 is disposed to the direct air flow over toy dart 10 during flight which enhances sound generation. It will be further appreciated that other configurations for wall member 24 may be employed without departing from the fair scope of the present invention, and that aperture 36 may be formed in disk portion 40, skirt portion 42 or both.

With continued reference to FIG. 4, interior surface 25 of wall member 24 is formed to include a plurality of structural ribs, one of which is shown as 46. Ribs 46 facilitate the release of end cap 22 from its molding tool. Where such release of end cap 22 from its mold is not required, ribs 46 are preferably omitted.

Figure 7:
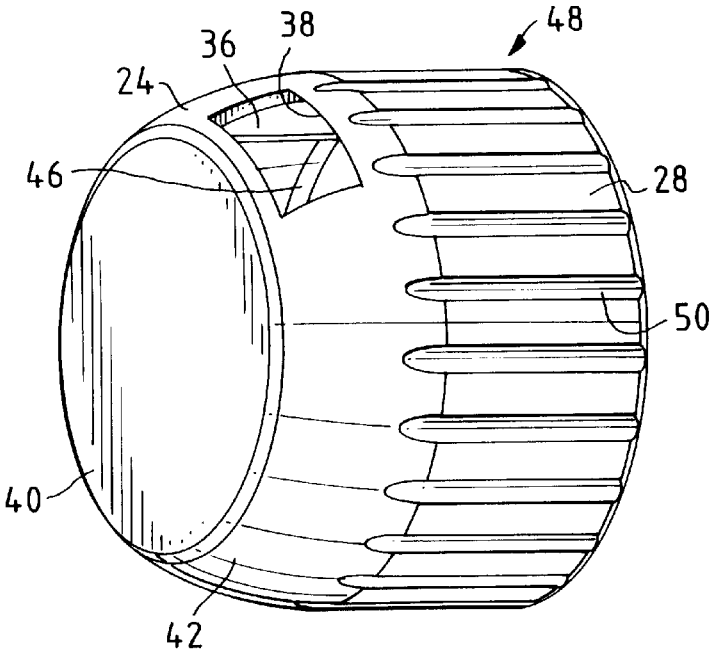
FIG. 7 is a perspective view of an end cap in accordance with an alternate preferred embodiment of the present invention.

Referring now to FIG. 7, an end cap 48 is shown. End cap 48 is substantially the same as end cap 22, and like reference numerals are utilized to identify like elements. End cap 48 is further formed to include a plurality of longitudinally extending ribs, one of which is shown as 50, formed on an outer surface 52 of flange 28 and skirt 42. Ribs 50 provide aesthetic detail to end cap 48.

Figure 8:
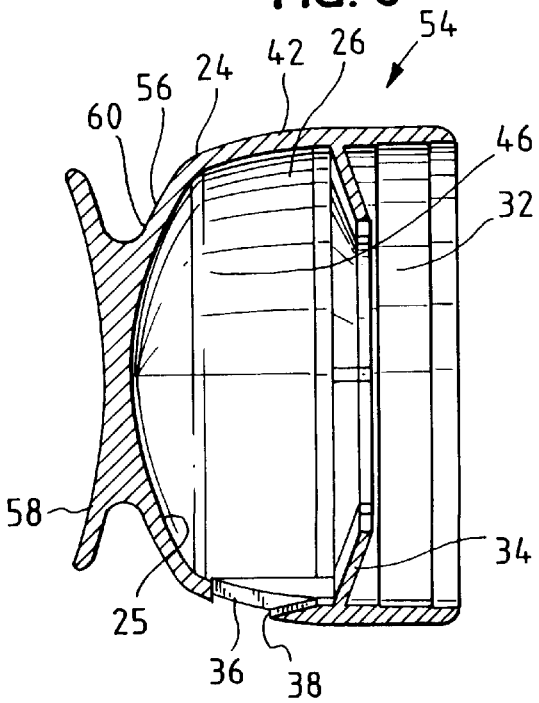
FIG. 8 cross-section view similar to FIG. 4 and further illustrating an end cap in accordance with an additional alternate preferred embodiment of the present invention.

Referring now to FIG. 8, an end cap 54 is shown. End cap 54 is again substantially similar to end cap 22 and like reference numerals again represent like elements. End cap 54 is formed with a disk portion 56 having a convex shape. Disk portion 56 is further formed to include a suction cup 58 on its outer, leading surface 60. Suction cup 58 preferably has a diameter less than the diameter of disk portion 54 so as to still permit the air flow to directly reach aperture 36. Suction cup 58 permits toy dart 10 to be fired at and become engaged with an object, while aperture 36 functions as described to both generate sound and enhance energy absorption.

The present invention has been described in terms of several alternative preferred embodiments, which are intended to illustrate the various features and advantages of the invention and should not be taken as limiting of the invention. The fair scope of the present invention is defined in the subjoined claims.

I claim:

1. A sound emitting toy dart comprising:

an elongate body having a first end and a second end, a sound emitting end cap secured to the first end, the end cap comprising a resilient wall member defining a cavity, and an aperture formed in the wall member, the aperture being in communication with the cavity; and the aperture including an edge portion arranged substantially perpendicular to an intended axis of flight of the toy dart for generating sound as a result of a flow of air over the aperture and the aperture further arranged to permit the evacuation of air from the cavity responsive to a collapsing of the wall member.

2. The dart of claim 1, wherein the aperture is configured as an edge tone whistle.

3. The dart of claim 1, wherein the end cap further comprises a mounting disk in engagement with the first end and with a flange formed within the cavity.

4. The dart of claim 1, wherein the wall member comprises an convex disk portion and an annular skirt portion extending from a circumference of the convex disk portion.

5. The dart of claim 4, wherein the aperture is formed in the skirt portion.

6. The dart of claim 1, wherein the end cap further comprises a plurality of rib members formed on an interior surface.

7. The dart of claim 1, wherein the end cap further comprises a plurality of rib members formed on an exterior surface.

8. An energy absorbing sound emitting end cap for use with a toy dart, the toy dart having an elongate body portion including a first end and a second end, the end cap comprising:

a resilient wall portion defining a cavity;

a flange portion extending from the wall portion, the flange portion sized to engage the first end of the toy dart for securing the end cap to the first end of the toy dart; and an aperture formed in the wall portion and in communication with the cavity, the aperture having an edge aligned substantially perpendicular to an intended axis of flight of the toy dart, wherein the edge and cavity cooperate to generate a sound resulting from a flow of air over the aperture and wherein the aperture and cavity cooperate to absorb energy.

9. The end cap of claim 8 further comprising, disposed adjacent the cavity, a mounting disk which engages the first end of the toy dart with the end cap secured to the first end of the toy dart.

10. The end cap of claim 9, a mounting disk flange extending into the cavity from at least one of the wall member and the flange portion, and the mounting disk being secured to the mounting disk flange.

11. The end cap of claim 8, the wall member comprising an end wall and an annular skirt portion extending from the end wall and coupled to the flange portion.

12. The end cap of claim 11, the aperture formed in the annular skirt portion.

13. The end cap of claim 11, the end wall having a convex shape.

14. The end cap of claim 8, further comprising a plurality of rib members formed on an interior surface.

15. The end cap of claim 8, further comprising a plurality of rib members formed on an exterior surface.

16. A toy projectile comprising:

a body portion including a first end and a second end;

an end cap secured to the first end, the end cap defining a cavity and including an aperture formed in the end cap and in communication with the cavity, the aperture arranged to generate sound from an external flow of air over the aperture during flight of the toy projectile and to permit the evacuation of air from the cavity responsive to a collapsing of the end cap upon an impact of the toy projectile with an object.

17. The toy projectile of claim 16, the aperture arranged as an edge-tone whistle.

18. The toy projectile of claim 16, wherein the end cap includes a suction cup portion formed on a leading surface thereof.

19. The toy projectile of claim 16, wherein the end cap further comprises a mounting disk in engagement with the first end and with a flange formed within the cavity.

20. The toy projectile of claim 16, wherein the end cap further comprises a plurality of ribs formed on at least one of an interior portion and an exterior portion of the end cap.

* * * * *